US005386711A

United States Patent [19]

Chen

[11] Patent Number: 5,386,711

[45] Date of Patent: Feb. 7, 1995

[54] DOUBLE KNIT MACHINE FOR KNITTING CONSTRUCTIVE FABRICS

[75] Inventor: Wan-Yih Chen, Taipei, Taiwan, Prov. of China

[73] Assignee: Pai Lung Machinery Mill Co., Ltd., Taipei, Taiwan, Prov. of China

[21] Appl. No.: 141,509

[22] Filed: Oct. 27, 1993

[51] Int. Cl.[6] ..... D04B 9/06; D04B 15/06

[52] U.S. Cl. ..... 66/19; 66/95; 66/25

[58] Field of Search ..... 66/8, 17, 19, 52, 57, 66/58, 95, 106, 107, 120, 25

[56] References Cited

U.S. PATENT DOCUMENTS

| | | | |
|---|---|---|---|
| 3,817,058 | 6/1974 | Lombardi | 66/19 X |
| 3,877,256 | 4/1975 | Roque | 66/19 X |
| 3,879,962 | 4/1975 | Mahler | 66/19 |
| 4,040,273 | 8/1977 | Bonazzi | 66/19 |
| 4,314,461 | 2/1982 | Conti | 66/120 X |
| 4,539,825 | 9/1985 | Colosio | 66/25 X |

*Primary Examiner*—Clifford D. Crowder
*Assistant Examiner*—John J. Calvert
*Attorney, Agent, or Firm*—Bacon & Thomas

[57] ABSTRACT

A double knit machine which includes a series of sinker assemblies disposed corresponding to the cylinder needles of the machine for holding down the knitted fabric during the raising stitch of the cylinder needles, each sinker assembly comprised of a fixed sinker having a sinker rib for guiding out the knitted fabric, and a presser sinker reciprocated by the cam drive of the machine, the presser sinker being moved forward to press the knitted fabric against the sinker rib of the respective fixed sinker as the respective cylinder needle is extended out, or moved backward to release from the knitted fabric as the respective cylinder needle is received back.

1 Claim, 7 Drawing Sheets

DOUBLE KNIT MACHINE FOR KNITTING CONSTRUCTIVE FABRICS

BACKGROUND OF THE INVENTION

The so-called constructive fabric is formed of a single thread through a knitting process. FIG. 1 shows a circular knitting machine according to the prior art which comprises a series of dial needles radially arranged on the same horizontal plane, and a series of cylinder needles vertically disposed corresponding to the series of dial needles. The dial needles and the cylinder needles form into a series of knitting units. As the cam of the knitting machine is activated, the dial and cylinder needles are respectively reciprocated at right angles (see FIGS. 1A and 1B), and therefore loops are respectively cast off and then formed into a fabric. The fabric thus formed is then gradually sent out downward through a fabric formation surface.

Conventional double knit machines are commonly used for knitting plain cotton cloths having no raised patterns. Therefore, the dial and cylinder needles of conventional double knit machines are controlled to complete cycles of knitting through a knit stitch knitting process, and the dial and cylinder needles of each knitting unit will constrain each other, i.e. the fully extended out dial needles will press on the edge of the fabric duly knitted to prevent the formation of "lifted fabric" during the raising stitch. These double knit machines have now been commonly used for knitting pique cloths having raised patterns on both sides thereof. In knitting a plain knitted fabric, the dial and cylinder needles are fully extended out and then received back after the casting of loops. In knitting a pique cloth, the dial (or cylinder) needles are fully extended out and then completely received back after the casting of loops while the cylinder (or dial) needles are retained immovably. Stitch adjustment of calibration (see FIG. 7, referenced by 6) are provided with the double knit machines for controlling the modes of the dial and cylinder needles so that they can be reciprocated or retained in position as desired. As the dial and cylinder needles of each knitting unit are not simultaneously reciprocated through a knit stitch mode, they do not constrain each other during the knitting process, and the fabric thus formed will be lifted by the cylinder needle being fully extended out during the raising stitch. This is the so-called "lifted fabric" phenomenon. As the raising and declining stitch of the knitting action are alternatively performed at a fast speed, this "lifted fabric" phenomenon will result in a miss while casting off a loop (See FIG. 1B), and the quality of the fabric is affected.

SUMMARY OF THE INVENTION

The present invention has been accomplished to provide a double knit machine which eliminates the aforesaid lifted fabric problem.

This object is achieved by installing a respective sinker assembly in the casing of the machine corresponding to each cylinder needle. The sinker assembly is comprised of a fixed sinker for supporting and guiding the knitted fabric, and a presser sinker disposed in parallel with the fixed sinker and reciprocated radially to press on the knitted fabric in time so as to prohibit the knitted fabric from being lifted by the respective cylinder needle.

The aforesaid fixed sinker is affixed to the casing of the double knit machine, and the presser sinker is reciprocated by the cam of the cam drive of the machine. Therefore, as the cylinder needle is extended out to cast off a loop, the corresponding presser sinker is moved forward to press the knitted fabric on the sinker rib of the corresponding fixed sinker. As the cylinder needle is received back to its former position, the respective presser sinker is synchronously moved backward to release the knitted fabric. The aforesaid motion is repeated again and again, and therefore the problem of lifted fabric is eliminated.

DETAILED DESCRIPTION OF THE PREFERRED EMBODIMENT

Figure 1:
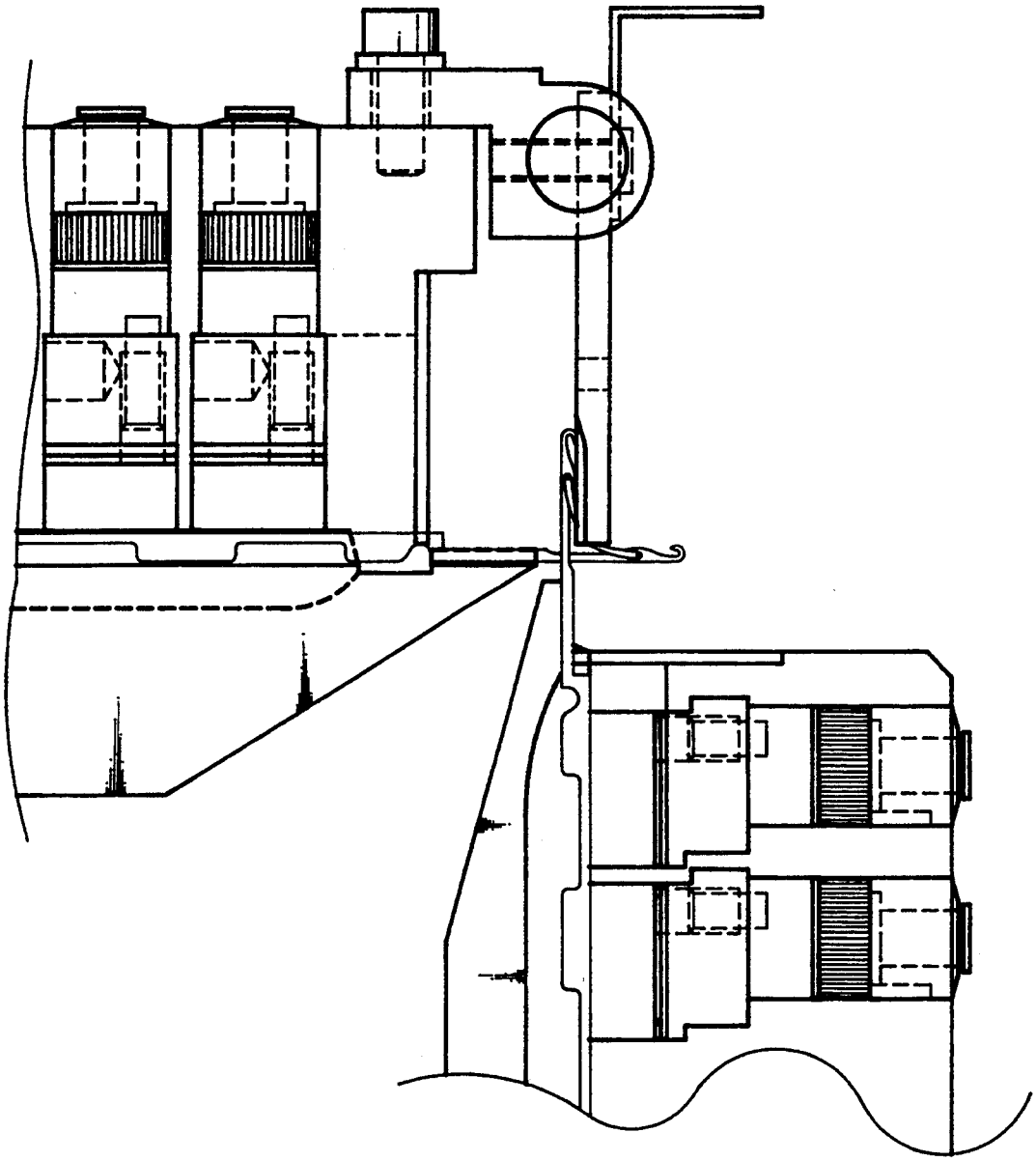
Fig. 1 PRIOR ART
FIG. 1 is a partial view in plain of a double knit machine according to the prior art.
Figure 1A:
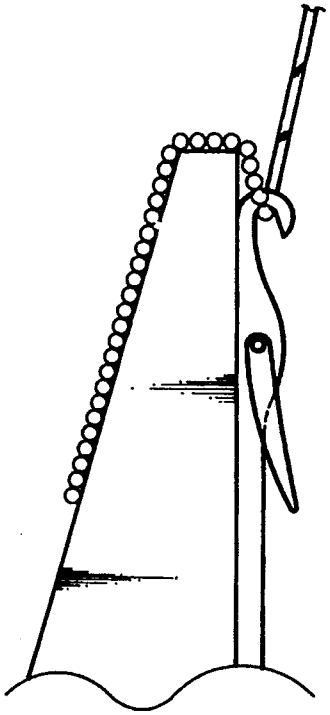
Fig. 1A PRIOR ART
FIG. 1A illustrates a cylinder needle of a prior art double knit machine hooked on the thread.
Figure 1B:
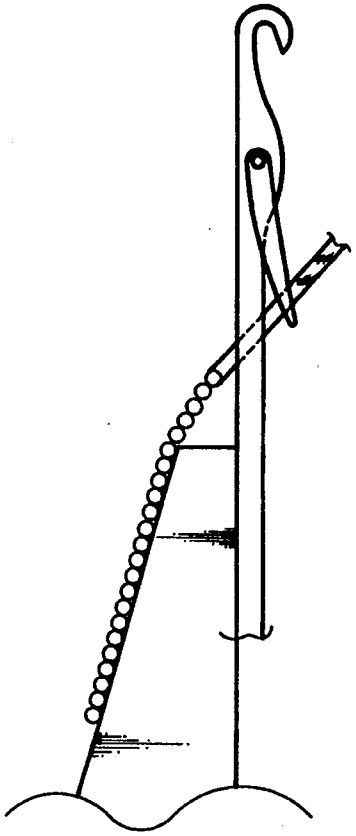
Fig. 1B PRIOR ART
FIG. 1B illustrates a cylinder needle of a prior art double knit machine fully extended out during its raising stitch.
Figure 2:
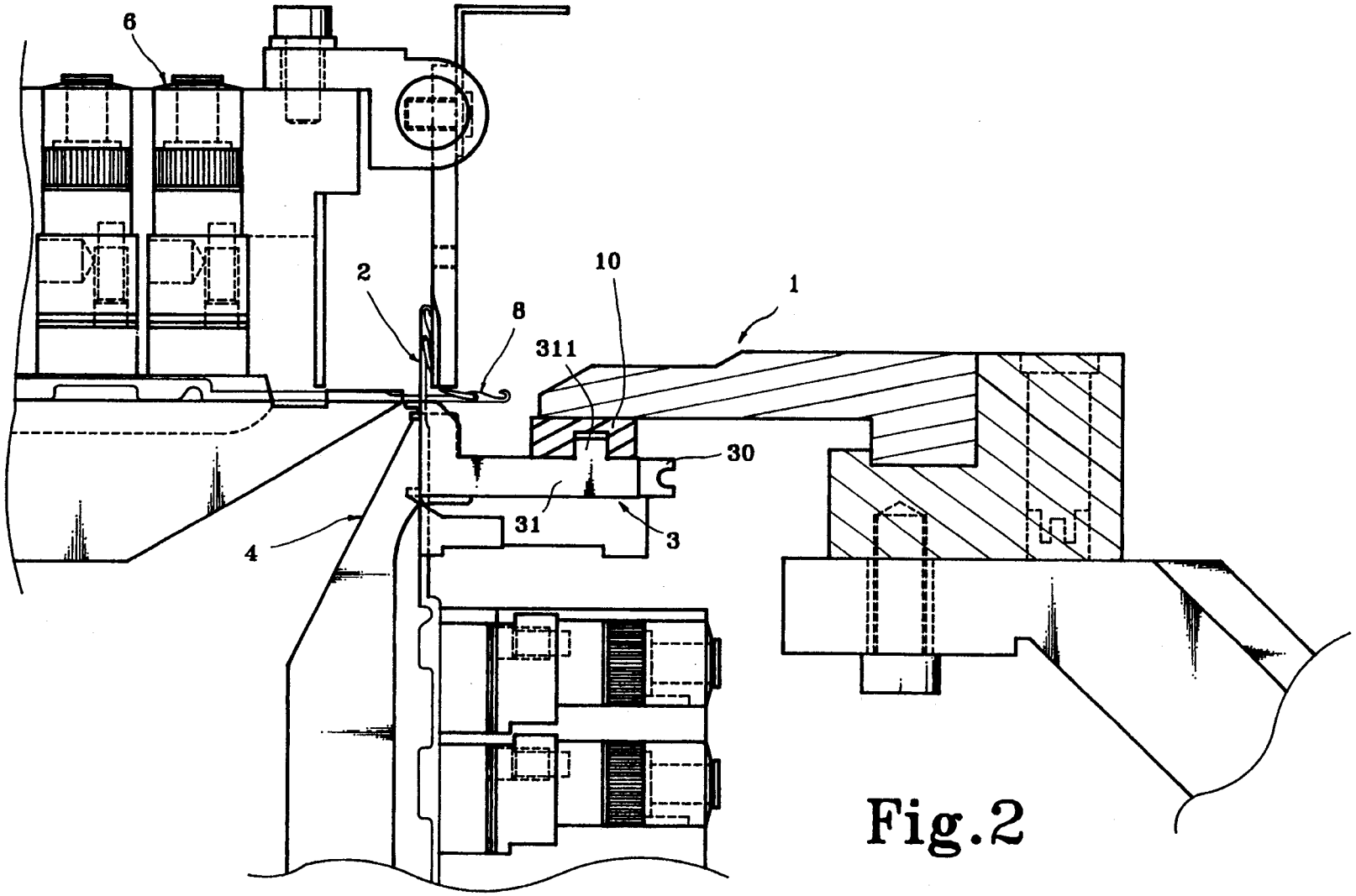
FIG. 2 is a partial view in plain of a double knit machine according to the present invention.
Figure 4:
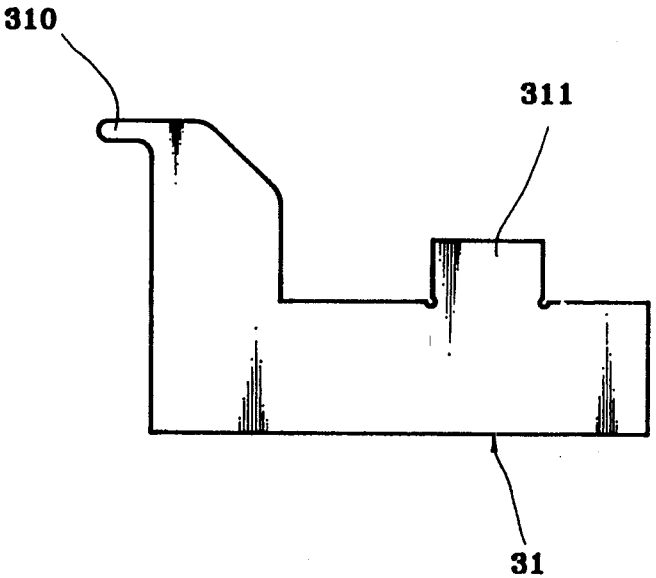
FIG. 4 is a plain view of a presser sinker according to the present invention.
Figure 3:
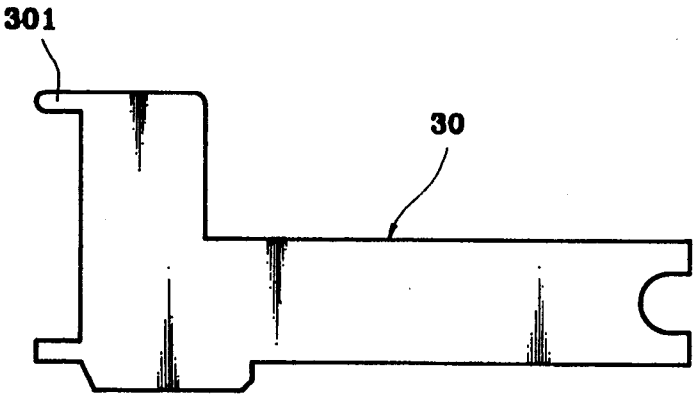
FIG. 3 is a plain view of a fixed sinker according to the present invention.

Referring to FIG. 2, a double knit machine is shown substantially similar to a conventional double knit machine. A series of sinker assemblies 3 are installed in the casing 1 of the double knit machine radially arranged on the same horizontal plane corresponding to the cylinder needles 2 of the double knit machine. Each sinker assembly 3 is comprised of a fixed sinker 30 and a presser sinker 31. The fixed sinker 30 has a sinker rib 301 projected from one end thereof and disposed in flush with the fabric formation surface 4 of the double knit machine (see FIG. 3) for guiding out the duly knitted fabric 5 out of the knitting mechanism of the double knit machine through the fabric formation surface 4. The presser sinker 31 is disposed at one side by the respective fixed sinker 30 and spaced therefrom by a gap for passing the respective cylinder needle 2 (see FIG. 4). The presser sinker 31 comprises a projecting sinker head 310 on one end thereof spaced from the sinker rib 301 of the respective fixed sinker 30 by a gap 32 (see FIG. 5). Within this gap 32, the duly knitted fabric 5 is retained and prevented from being lifted by the cylinder needle 2 during its raising stitch. Therefore, the problem of "lifted fabric" is eliminated.

Figure 6:
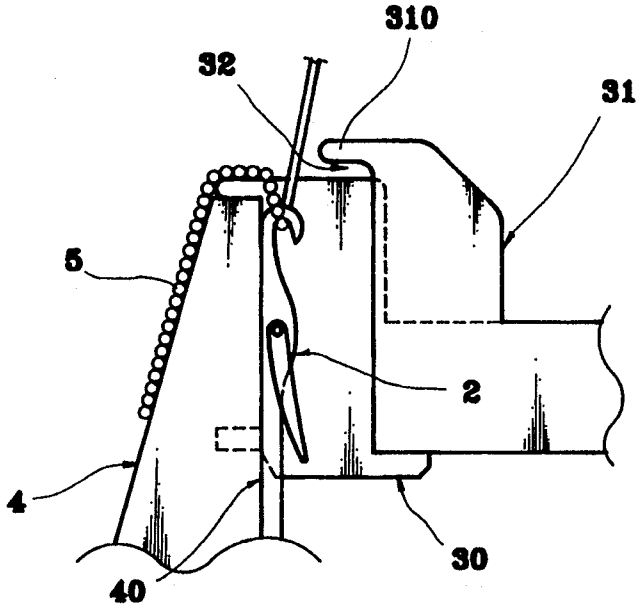
FIG. 6 shows the relative motion between the cylinder needle and the matching presser sinker during the declining stitch of the cylinder needle.
Figure 5:
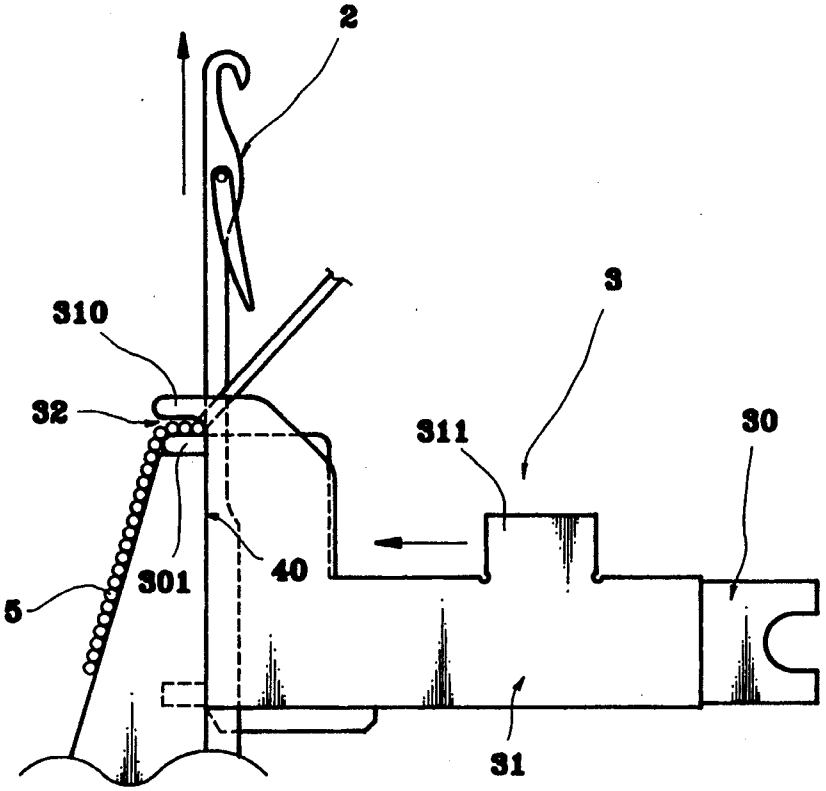
FIG. 5 shows the relative motion between the cylinder needle and the matching presser sinker during the raising stitch of the cylinder needle.
Figure 7:
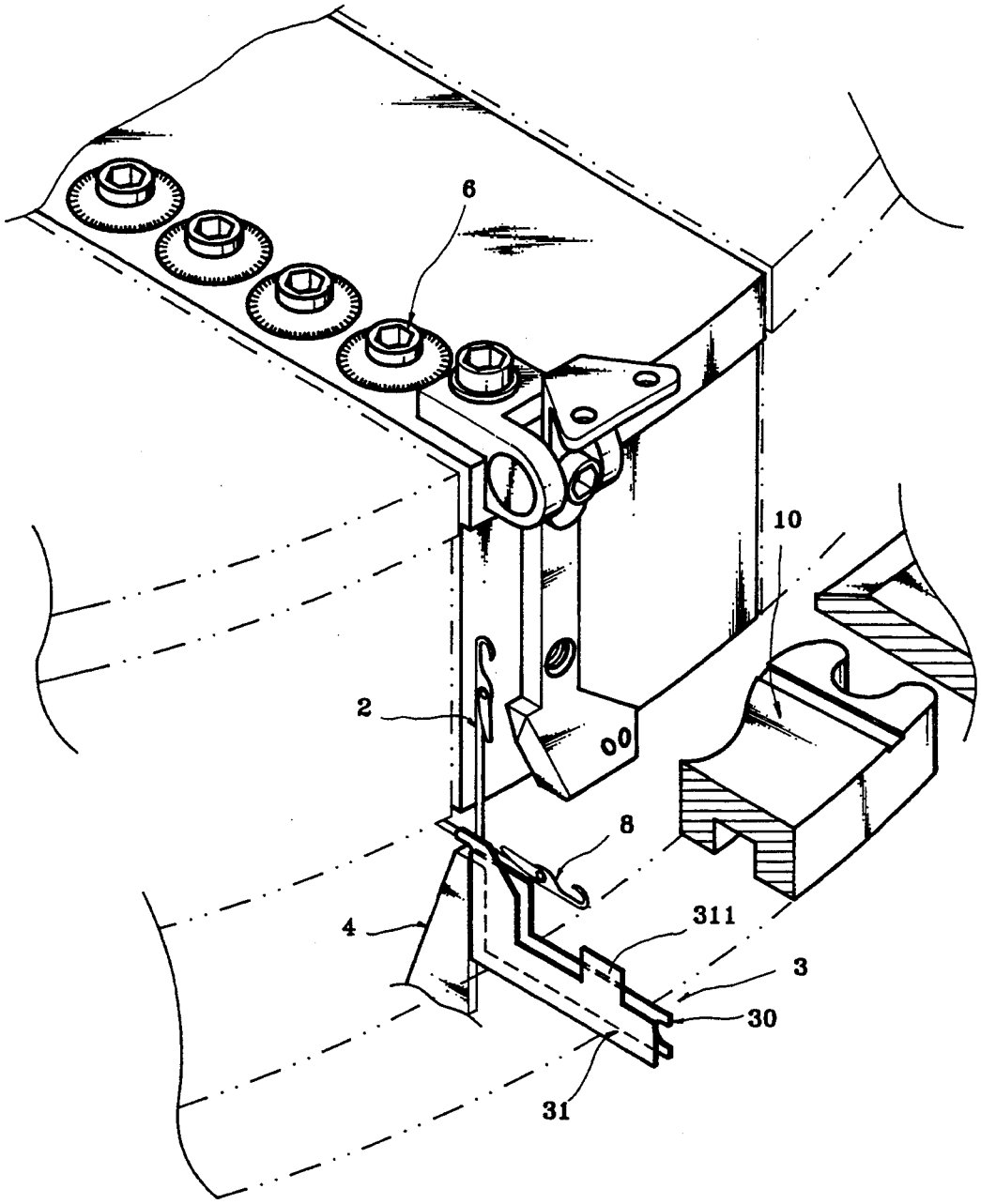
FIG. 7 is a partial view in perspective of the double knit machine of FIG. 2.

On the casing 1 of the double knit machine, there are radial sinker slots (not shown) which receive the presser sinkers 31 of the sinker assemblies 3. The presser sinker 31 of each sinker assembly 3 further comprises an upright guide strip 311 on the top in the middle inserted in a bottom annular groove of the cam 10 (see FIG. 7). As the cam 10 is activated, the presser sinker 31 is reciprocated radially. The relative motion between the presser sinker 31 and the respective cylinder needle 2 is shown in FIGS. 5 and 6. As the cylinder needle 2 is vertically moved upward during its raising stitch, the projecting sinker head 310 of the presser sinker 31 is pressed on the fabric 5 above the sinker rib 301 of the fixed sinker 30; as the cylinder needle 2 is received back during its declining stitch, the projecting sinker head 310 of the presser sinker 31 is removed from the sinker rib 301 of the fixed sinker 30 so as not to interfere with the knitting action.

Figure 8:
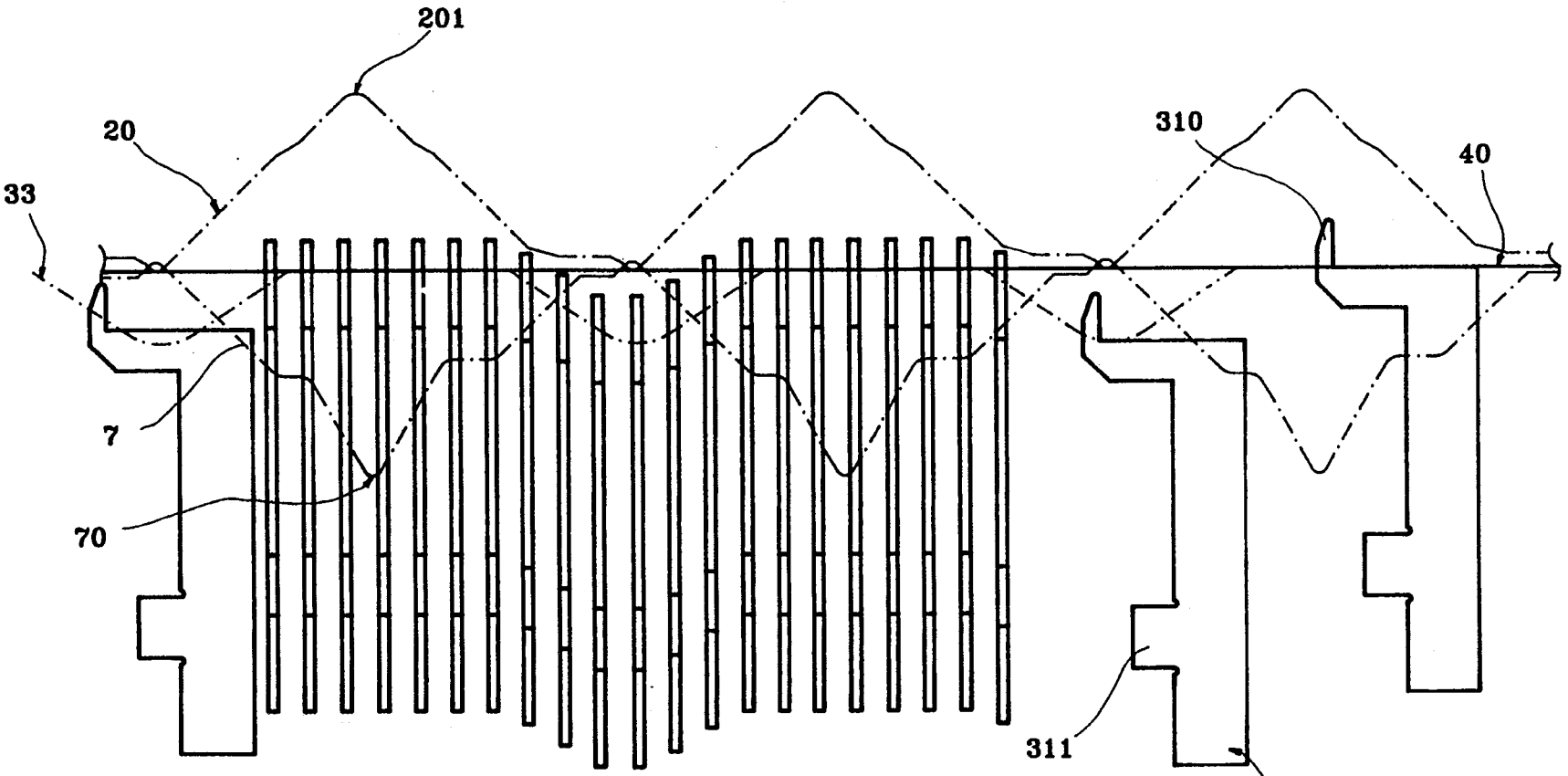
FIG. 8 is a layout showing the relative relations between the tracks of the presser sinkers, the cylinder needles, and the dial needles according to the present invention.

Referring to FIG. 8, therein illustrated shows the relative relations between the track 33 of the presser sinker 31 and the tracks 7;20 of the dial and cylinder needles. As illustrated, when the cylinder needle of each knitting unit reaches the knit stitch point 201 and the respective dial needle is disposed at the welt stitch point 70 (retained immovable), the respective presser sinker 31 is fully extended out to pass its projecting sinker head 310 over the front edge 40 of the fabric formation surface 4, and therefore the duly knitted fabric 5 is pressed by the projecting sinker head 310. Because the presser sinker 31 is synchronously moved with the reciprocating movement of the respective cylinder needle, the duly knitted fabric 5 is retained by the presser sinker 31 during the raising stitch of the cylinder needle, and therefore the duly knitted fabric 5 will not be lifted by the cylinder needle during the knitting process.

As indicated, the present invention provides a series of sinker assemblies which firmly hold down the knitted fabric during the raising stitch stroke of the cylinder needles so that the problem of lifted fabric is eliminated.

I claim:

1. A double knit machine of the type having a series of horizontal dial needles and a series of vertical cylinder needles alternatively reciprocated by a cam drive mechanism to knit a double-faced fabric, and further having a plurality of sinker assemblies radially arranged in a horizontal plane, each sinker assembly comprising:

a) a fixed sinker affixed to the double knit machine and comprising a sinker rib extending from one end thereof having a fabric formation surface for guiding out the duly knitted fabric; and, b) a presser sinker comprising:

i) a projecting head on one end thereof spaced from said sinker rib of said fixed sinker for pressing the duly knitted fabric during a raising stitch of the respective cylinder needle; and ii) an upright guide strip inserted into the cam drive mechanism of the double knit machine, such that said presser sinker is reciprocated radially as the respective cylinder needle is reciprocated vertically, the projecting sinker head of said presser sinker being pressed on the duly knitted fabric against the sinker rib of the respective fixed sinker as the respective cylinder needle is extended out, and the projecting sinker head of said presser sinker is removed from the duly knitted fabric as the respective cylinder needle is received back.

* * * * *